US011715440B2

(12) United States Patent
Ahn et al.

(10) Patent No.: US 11,715,440 B2
(45) Date of Patent: Aug. 1, 2023

(54) DISPLAY DEVICE AND METHOD OF DRIVING THE SAME

(71) Applicant: Samsung Display Co., Ltd., Yongin-Si (KR)

(72) Inventors: Gwangsoo Ahn, Suwon-si (KR); Jong Jae Lee, Hwaseong-si (KR); Taegon Im, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/541,616

(22) Filed: Dec. 3, 2021

(65) Prior Publication Data

US 2022/0208141 A1 Jun. 30, 2022

(30) Foreign Application Priority Data

Dec. 29, 2020 (KR) ..... 10-2020-0185867

(51) Int. Cl.
*G09G 3/36* (2006.01)
*G09G 5/00* (2006.01)

(52) U.S. Cl.
CPC ..... *G09G 5/008* (2013.01); *G09G 3/36* (2013.01); *G09G 2330/02* (2013.01)

(58) Field of Classification Search
CPC .. G09G 3/3648; G09G 3/3674; G09G 3/3677; G09G 5/008; G09G 3/36; G09G 2330/00
See application file for complete search history.

(56) References Cited

U.S. PATENT DOCUMENTS

2008/0218232 A1* 9/2008 Jeon ..... G09G 3/20 327/165
2013/0050176 A1* 2/2013 Kim ..... G09G 3/3688 345/87
2020/0098312 A1* 3/2020 Cho ..... G09G 3/3275

FOREIGN PATENT DOCUMENTS

KR 1020140023711 A 2/2014
KR 1020190076219 A 7/2019

* cited by examiner

*Primary Examiner* — Roy P Rabindranath
(74) *Attorney, Agent, or Firm* — Cantor Colburn LLP

(57) ABSTRACT

A display device may include a display panel including a gate line, a data line, and a pixel electrically connected to the gate line and the data line, where display panel displays an image based on input image data, a gate driver which outputs a gate signal to the gate line, a data driver which outputs a data voltage to the data line, and a power supply voltage generator which provides a driving voltage to the display panel, the gate driver and the data driver. The power supply voltage generator generates a gate clock signal based on an on-clock signal and an off-clock signal and changes a count value of the on-clock signal or the off-clock signal when the gate clock signal is an abnormal signal.

20 Claims, 11 Drawing Sheets

DISPLAY DEVICE AND METHOD OF DRIVING THE SAME

This application claims priority to Korean Patent Application No. 10-2020-0185867, filed on Dec. 29, 2020, and all the benefits accruing therefrom under 35 U.S.C. § 119, the content of which in its entirety is herein incorporated by reference.

BACKGROUND

1. Field

The disclosure relates to a display device and a method of driving the display device, and more particularly, to a display device and a method of driving the display device, in which an abnormal signal of a gate clock signal is corrected into a normal signal.

2. Description of the Related Art

In general, a display device may include a display panel and a display panel driver. The display panel may display an image based on input image data, and may include a plurality of gate lines, a plurality of data lines, and a plurality of pixels. The display panel driver may include a gate driver configured to provide a gate signal to the gate lines, a data driver configured to provide a data voltage to the data lines, a driving controller configured to control the gate driver and the data driver, and a power supply voltage generator configured to provide a driving voltage to the display panel, the gate driver, and the data driver.

SUMMARY

In a display device, an on-clock signal and an off-clock signal may be abnormally output due to a malfunction of the driving controller caused by an external factor such as static electricity or a momentary electrical surge. When the on-clock signal and the off-clock signal of the display device are abnormally output, an abnormal display screen may be displayed on a display panel. Therefore, when the on-clock signal and the off-clock signal are abnormally output, it is desired to correct a gate clock signal.

Embodiments of the disclosure provide a display device capable of detecting an abnormal gate clock signal and correcting the gate clock signal into a normal signal, thereby improving reliability.

Embodiments of the disclosure provide a method of driving a display device, capable of detecting an abnormal gate clock signal and correcting the gate clock signal into a normal signal, thereby improving reliability.

According to an embodiment of the invention, a display device includes a display panel including a gate line, a data line, and a pixel electrically connected to the gate line and the data line, where the display panel displays an image based on input image data, a gate driver which outputs a gate signal to the gate line, a data driver which outputs a data voltage to the data line, and a power supply voltage generator which provides a driving voltage to the display panel, the gate driver, and the data driver. In such an embodiment, the power supply voltage generator generates a gate clock signal based on an on-clock signal and an off-clock signal and changes a count value of the on-clock signal or the off-clock signal when the gate clock signal is an abnormal signal.

In an embodiment, the power supply voltage generator may determine whether the gate clock signal is the abnormal signal based on a length of an activation period of the gate clock signal.

In an embodiment, the power supply voltage generator may calculate a gate clock reference time by calculating a time during which the activation period of the gate clock signal is maintained based on the on-clock signal and the off-clock signal.

In an embodiment, the power supply voltage generator may obtain a gate clock actual time by feeding back the gate clock signal output from an output terminal of the power supply voltage generator and determine the gate clock signal as the abnormal signal when the gate clock reference time and the gate clock actual time are different from each other.

In an embodiment, the power supply voltage generator may count an activation period of the on-clock signal or the off-clock signal and generate the gate clock signal corresponding to the count value of the on-clock signal or the off-clock signal.

In an embodiment, the power supply voltage generator may adjust the length of the activation period of the gate clock signal by increasing or decreasing the count value of the on-clock signal or the off-clock signal when the gate clock signal is the abnormal signal.

In an embodiment, the power supply voltage generator may include a calculator which calculates a gate clock reference time by calculating a time during which the activation period of the gate clock signal is maintained based on the on-clock signal and the off-clock signal, a comparator which obtains a gate clock actual time by feeding back the gate clock signal output from an output terminal and compares the gate clock reference time with the gate clock actual time, and a gate controller which outputs the gate clock signal to the output terminal and corrects the gate clock signal into a normal signal by increasing or decreasing the count value of the on-clock signal or the off-clock signal when the gate clock signal is the abnormal signal.

In an embodiment, the calculator may calculate the gate clock reference time as a multiplication of a time during which an activation period of the on-clock signal is maintained and a number of types of the gate clock signal.

In an embodiment, the comparator may generate a clock recovery signal when the gate clock reference time and the gate clock actual time are different from each other and transmit the clock recovery signal to the gate controller.

In an embodiment, the gate controller may recover a count value before a loss of the on-clock signal by decreasing the count value of the on-clock signal when the gate clock signal is the abnormal signal due to the loss of the on-clock signal.

In an embodiment, the gate controller may recover a count value before a loss of the off-clock signal by increasing the count value of the off-clock signal when the gate clock signal is the abnormal signal due to the loss of the off-clock signal.

According to an embodiment of the invention, a method of driving a display device includes generating an on-clock signal and an off-clock signal, generating a gate clock signal based on the on-clock signal and the off-clock signal, determining whether the gate clock signal is an abnormal signal based on a length of an activation period of the gate clock signal, and changing a count value of the on-clock signal or the off-clock signal when the gate clock signal is the abnormal signal.

In an embodiment, the method may further include calculating a gate clock reference time by calculating a time during which the activation period of the gate clock signal is maintained based on the on-clock signal and the off-clock signal.

In an embodiment, a gate clock actual time may be obtained by feeding back the gate clock signal output from an output terminal, and the gate clock signal may be determined as the abnormal signal when the gate clock reference time and the gate clock actual time are different from each other.

In an embodiment, the method may further include counting an activation period of the on-clock signal or the off-clock signal and generating the gate clock signal corresponding to the count value of the on-clock signal or the off-clock signal.

In an embodiment, the length of the activation period of the gate clock signal may be adjusted by increasing or decreasing the count value of the on-clock signal or the off-clock signal when the gate clock signal is the abnormal signal.

In an embodiment, the method may further include calculating a gate clock reference time by calculating a time during which the activation period of the gate clock signal is maintained based on the on-clock signal and the off-clock signal, obtaining a gate clock actual time by feeding back the gate clock signal output from an output terminal, and comparing the gate clock reference time with the gate clock actual time. In such an embodiment, the gate clock signal may be output to the output terminal, and the gate clock signal may be corrected into a normal signal by increasing or decreasing the count value of the on-clock signal or the off-clock signal when the gate clock signal is the abnormal signal.

In an embodiment, the calculating the gate clock reference time may include calculating the gate clock reference time as a multiplication of a time during which an activation period of the on-clock signal is maintained and a number of types of the gate clock signal.

In an embodiment, the comparing the gate clock reference time with the gate clock actual time may include generating a clock recovery signal when the gate clock reference time and the gate clock actual time are different from each other.

In an embodiment, the on-clock signal may be recovered to have a count value before a loss of the on-clock signal by decreasing the count value of the on-clock signal when the gate clock signal is the abnormal signal due to the loss of the on-clock signal, and the off-clock signal may be recovered to have a count value before a loss of the off-clock signal by increasing the count value of the off-clock signal when the gate clock signal is the abnormal signal due to the loss of the off-clock signal.

According to embodiments of the display device and the method of driving the display device as described above, the display device may detect an abnormal gate clock signal caused by the loss of the on-clock signal or the off-clock signal and may correct the gate clock signal into a normal signal. Accordingly, in such embodiments of the display device, visual recognition of noise by a user may be minimized, and display quality defects of the display device may be reduced. As a result, in such embodiments of the display device, safety and reliability of the display device may be improved.

DETAILED DESCRIPTION

Figure 1:
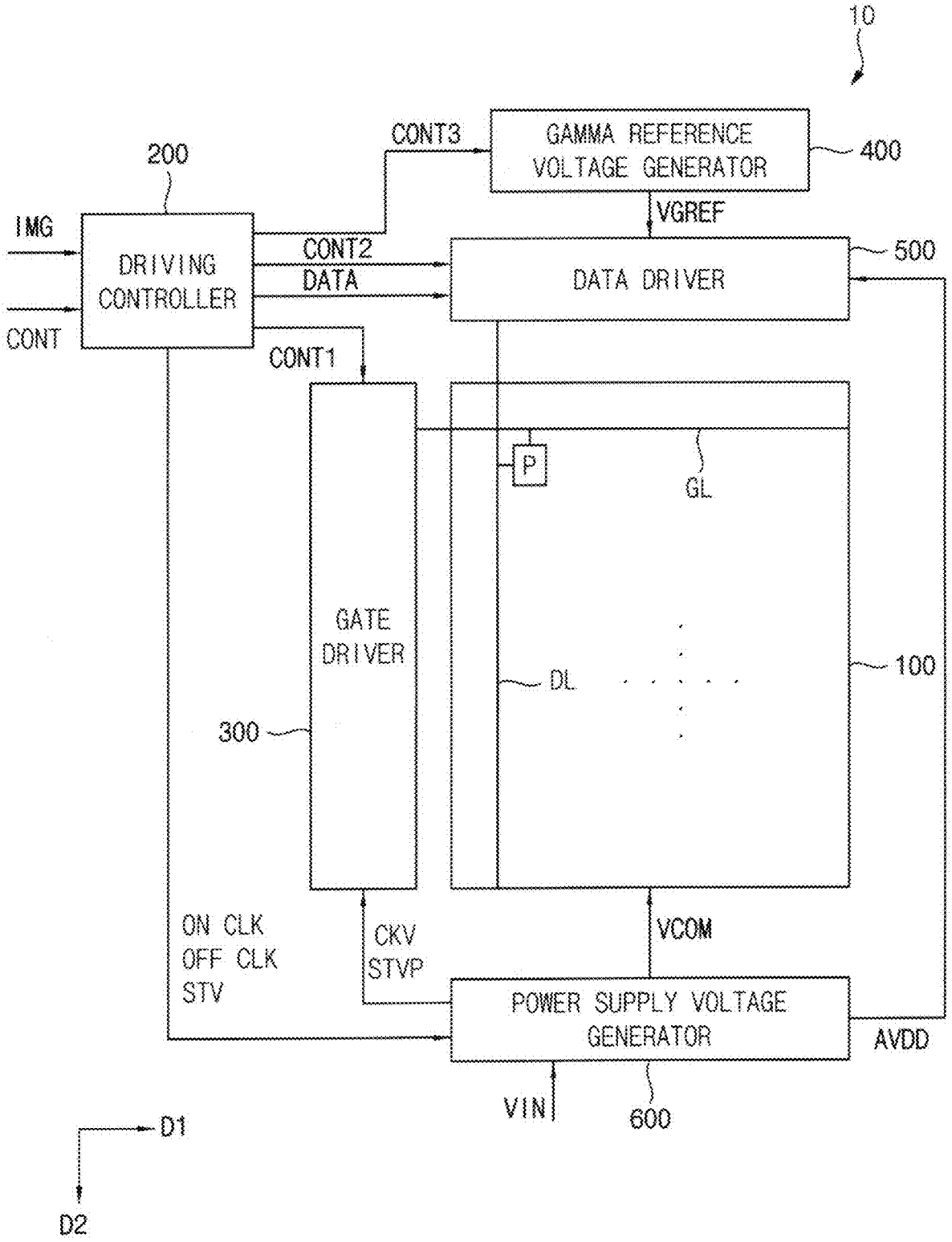
FIG. 1 is a block diagram showing a display device according to an embodiments

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

FIG. 1 is a block diagram showing a display device 10 according to an embodiment.

Referring to FIG. 1, an embodiment of a display device 10 may include a display panel 100 and a display panel driver. The display panel driver may include a driving controller 200, a gate driver 300, a gamma reference voltage generator 400, and a data driver 500. The display panel driver may further include a power supply voltage generator 600.

In one embodiment, for example, the driving controller 200 and the data driver 500 may be integrally formed. In one embodiment, for example, the driving controller 200, the gamma reference voltage generator 400, and the data driver 500 may be integrally formed as a single unit, e.g., a single circuit unit. A driving module in which at least the driving controller 200 and the data driver 500 are integrally formed may be referred to as a timing controller-embedded data driver ("TED").

The display panel 100 may include a display part for displaying an image and a peripheral part adjacent to the display part.

The display panel 100 may include a plurality of gate lines GL, a plurality of data lines DL, and a plurality of pixels P electrically connected to the gate lines GL and the data lines DL, respectively. The gate lines GL may extend in a first direction D1, and the data lines DL may extend in a second direction D2 intersecting the first direction D1.

The driving controller 200 may receive input image data IMG and an input control signal CONT from an external device (not shown). In one embodiment, for example, the input image data IMG may include red image data, green image data, and blue image data. The input image data IMG may further include white image data. Alternatively, the input image data IMG may include magenta image data, yellow image data, and cyan image data. The input control signal CONT may include a master clock signal and a data enable signal. The input control signal CONT may further include a vertical synchronization signal and a horizontal synchronization signal.

The driving controller 200 may generate a first control signal CONT1, a second control signal CONT2, a third control signal CONT3, and a data signal DATA based on the input image data IMG and the input control signal CONT.

The driving controller 200 may generate the first control signal CONT1 for controlling an operation of the gate driver 300 based on the input control signal CONT to output the generated first control signal CONT1 to the gate driver 300. The first control signal CONT1 may include a vertical start signal.

The driving controller 200 may generate the second control signal CONT2 for controlling an operation of the data driver 500 based on the input control signal CONT to output the generated second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generates the third control signal CONT3 for controlling an operation of the gamma reference voltage generator 400 based on the input control signal CONT to output the generated third control signal CONT3 to the gamma reference voltage generator 400.

The gate driver 300 may generate gate signals for driving the gate lines GL in response to the first control signal CONT1 received from the driving controller 200. The gate driver 300 may output the gate signals to the gate lines GL. In one embodiment, for example, the gate driver 300 may sequentially output the gate signals to the gate lines GL. In an embodiment, the gate driver 300 may be implemented as an amorphous silicon gate ("ASG") circuit using an amorphous silicon thin film transistor ("a-Si TFT"), and may be mounted on the peripheral part of the display panel 100. According to an alternative embodiment, the gate driver 300 may be implemented by using an oxide semiconductor, a crystalline semiconductor, a polycrystalline semiconductor, or the like, and may be mounted on the peripheral part of the display panel 100.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to each data signal DATA.

In an embodiment of the disclosure, the gamma reference voltage generator 400 may be disposed in the driving controller 200 or in the data driver 500.

The data driver 500 may receive the second control signal CONT2 and the data signal DATA from the driving controller 200, and may receive the gamma reference voltage VGREF from the gamma reference voltage generator 400. The data driver 500 may convert the data signal DATA into an analog data voltage by using the gamma reference voltage VGREF. The data driver 500 may output the data voltage to the data line DL. In one embodiment, for example, the data driver 500 may be mounted on the peripheral part of the display panel 100. In one embodiment, for example, the data driver 500 may be integrated in the peripheral part of the display panel 100.

The power supply voltage generator 600 may provide a power supply voltage to at least one selected from the display panel 100, the driving controller 200, the gate driver 300, the gamma reference voltage generator 400 and the data driver 500. In an embodiment, the power supply voltage generator 600 may include a direct current-to-direct current ("DC-DC") converter. The power supply voltage generator 600 may generate a common voltage VCOM based on an input voltage VIN to output the generated common voltage VCOM to the display panel 100. According to an embodiment, the display device 10 may be a liquid crystal display device 10 including a liquid crystal layer. However, the disclosure is not limited to the liquid crystal display 10.

In an embodiment, the power supply voltage generator 600 may generate a gate clock signal CKV and a gate start signal STVP, which are used to generate the gate signal, to output the generated gate clock signal CKV and the generated gate start signal STVP to the gate driver 300. The power supply voltage generator 600 may receive an on-clock signal ON CLK, an off-clock signal OFF CLK, and a vertical start signal STV from the driving controller 200. The vertical start signal STV may be a signal representing or indicating the start of one frame. The power supply voltage generator 600 may generate the gate clock signal CKV and the gate start signal STVP based on the on-clock signal ON CLK, the off-clock signal OFF CLK and the vertical start signal STV. In such an embodiment, the on-clock signal ON CLK may be synchronized with a rising edge of the gate clock signal, and the off-clock signal OFF CLK may be synchronized with a falling edge of the gate clock signal. In an embodiment, the power supply voltage generator 600 may generate an analog high voltage AVDD for determining a level of the data voltage to output the generated analog high voltage AVDD to the data driver 500.

Figure 2:
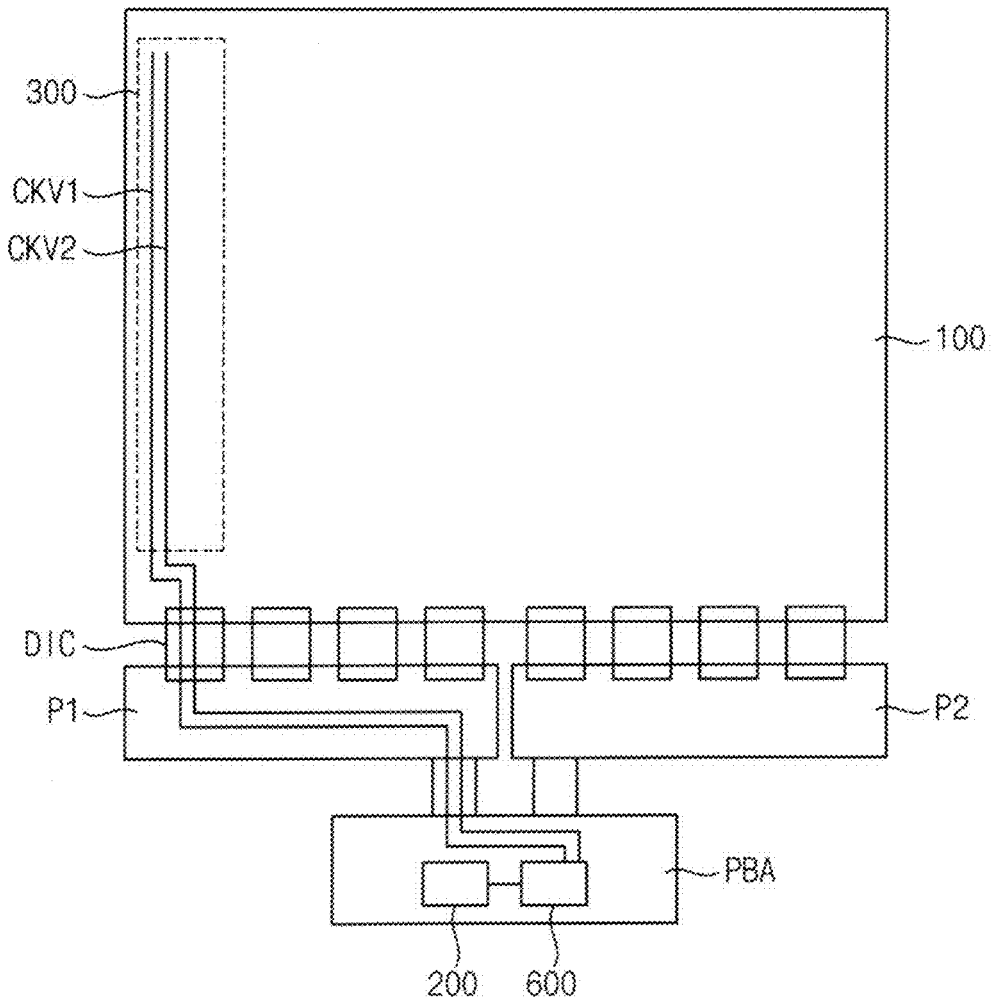
FIG. 2 is a plan view showing an embodiment of the display device of FIG. 1.

FIG. 2 is a plan view showing an embodiment of the display device 10 of FIG. 1.

Referring to FIGS. 1 and 2, in an embodiment, the driving controller 200 and the power supply voltage generator 600 may be disposed in a printed circuit board assembly PBA. The printed circuit board assembly PBA may be connected to a first printed circuit P1 and a second printed circuit P2.

In one embodiment, for example, the data driver 500 may include a plurality of data driver chips DIC connected between the first printed circuit P1 and the display panel 100, and a plurality of data driver chips DIC connected between the second printed circuit P2 and the display panel 100.

According to an embodiment, the gate driver 300 may be disposed in the display panel 100. The power supply voltage generator 600 may output gate clock signals CKV1 and CKV2 to the gate driver 300 disposed in the display panel 100. The gate lines for applying the gate clock signals CKV1 and CKV2 may be disposed on the display panel 100.

Figure 3:
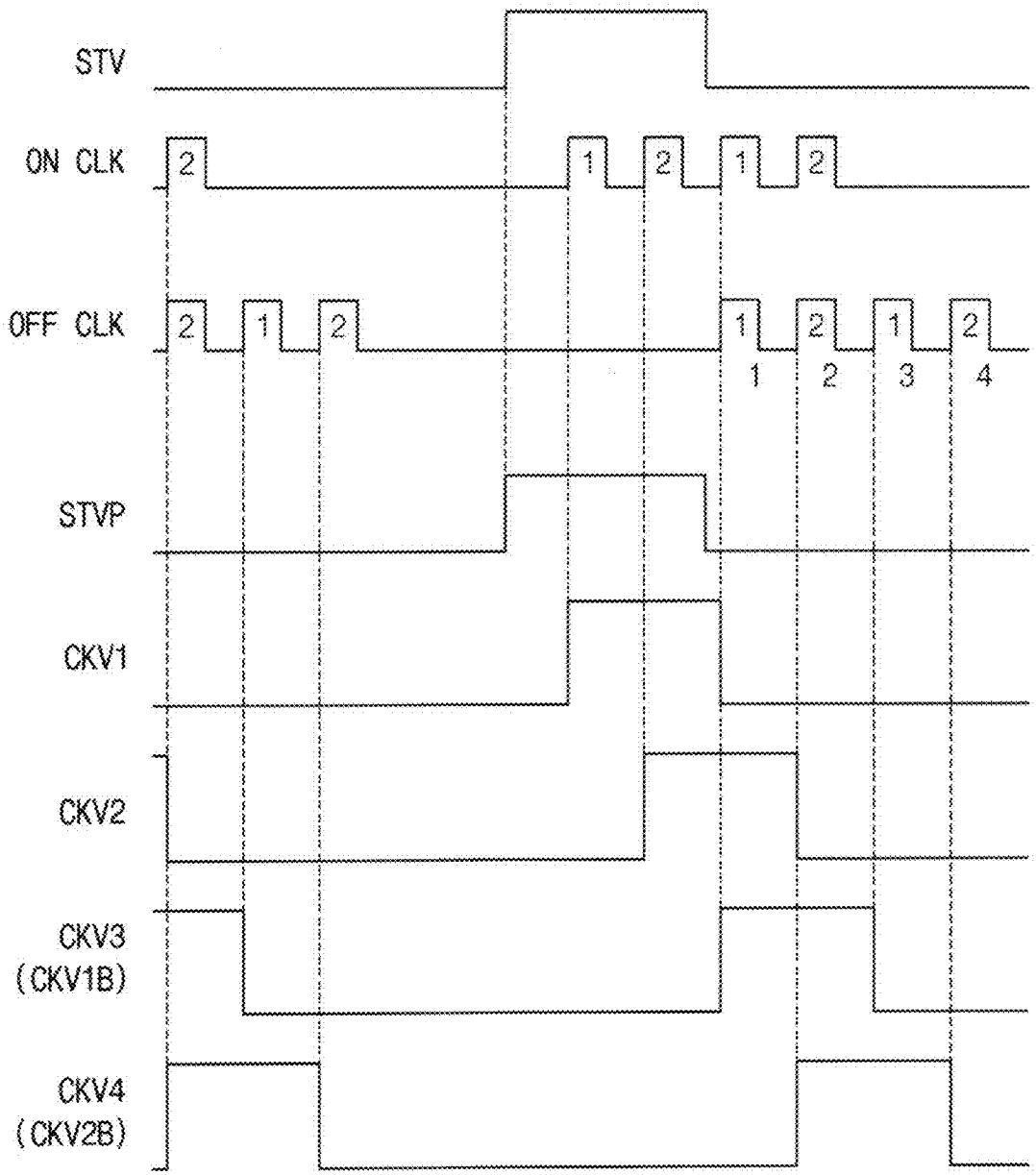
FIG. 3 is a timing diagram showing an embodiment of input and output signals of a power supply voltage generator in FIG. 1.

FIG. 3 is a timing diagram showing an embodiment of input and output signals of a power supply voltage generator 600 in FIG. 1.

Referring to FIGS. 1 to 3, the power supply voltage generator 600 may receive the on-clock signal ON CLK, the off-clock signal OFF CLK, and the vertical start signal STV from the driving controller 200. The power supply voltage generator 600 may generate the gate clock signal CKV and the gate start signal STVP based on the on-clock signal ON CLK, the off-clock signal OFF CLK, and the vertical start signal STV. In an embodiment, a rising time of each of gate clock signals at which the gate clock signal rises from a gate low voltage to a gate high voltage may be determined by a rising edge of the on-clock signal ON CLK. In such an embodiment, a falling time of each of the gate clock signals at which the gate clock signal falls from the gate high voltage to the gate low voltage may be determined by a falling edge of the off-clock signal OFF CLK. Each of a plurality of gate clock signals may have an activation period (e.g., a gate high voltage period) that partially overlaps an activation period of an adjacent gate clock signal. The power supply voltage generator 600 may generate the gate clock signal CKV and the gate start signal STVP to output the generated gate clock signal CKV and the generated gate start signal STVP to the gate driver 300. Although the gate clock signal has been illustrated in FIG. 3 as including two phases (e.g., 1 and 2 in the on-clock signal ON CLK and the off-clock signal OFF CLK) and four clocks (e.g., first to fourth clock signals CKV1, CKV2, CKV3 (or CKV1B) and CKV4 (or CKV2B)), embodiments of the disclosure are not limited thereto, and a number of types of the gate clock signal may be further expanded.

In an embodiment, the on-clock signal ON CLK and the off-clock signal OFF CLK may be abnormally output due to a malfunction of the driving controller 200 caused by an external factor such as static electricity or a momentary electrical surge. In this case, the gate clock signal generated by the power supply voltage generator 600 may also be an abnormal signal. If such an abnormal gate clock signal is input to the gate driver, the display panel may display an abnormal image. In an embodiment of the display device according to the invention, the power supply voltage generator 600 may determine whether the gate clock signal is an abnormal signal, and change a count value of the on-clock signal ON CLK or the off-clock signal OFF CLK when the gate clock signal is the abnormal signal such that the display panel may be effectively prevented from displaying the abnormal image. In an embodiment, the power supply voltage generator 600 may determine whether the gate clock signal is the abnormal signal based on a length of the activation period of the gate clock signal. When the gate clock signal is determined as the abnormal signal, the count value of the on-clock signal ON CLK or the off-clock signal OFF CLK is changed, such that the gate clock signal may be corrected into a normal signal. When the gate clock signal is corrected into the normal signal, the display panel may display a normal image. Accordingly, in such an embodiment of the display device, visual recognition of noise by a user may be minimized, and display quality defects of the display device may be reduced. An embodiment of a method of correcting the gate clock signal will be described in detail below with reference to FIGS. 4 to 8.

Figure 4:
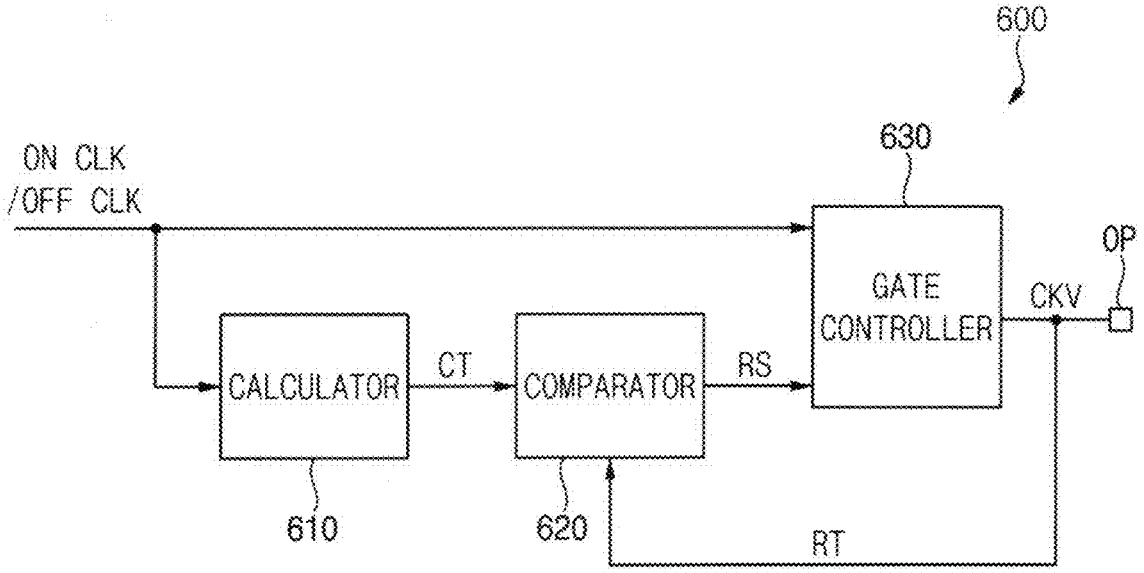
FIG. 4 is a block diagram showing an embodiment of a power supply voltage generator in FIG. 1.

FIG. 4 is a block diagram showing an embodiment of a power supply voltage generator 600 in FIG. 1.

Referring to FIG. 4, an embodiment of the power supply voltage generator 600 may include a calculator 610, a comparator 620, and a gate controller 630. The calculator 610 may receive the on-clock signal ON CLK and the off-clock signal OFF CLK, and calculate a gate clock reference time CT. The comparator 620 may receive the gate clock reference time CT and a gate clock actual time RT, and generate a clock recovery signal RS. The gate controller 630 may receive the on-clock signal ON CLK and the off-clock signal OFF CLK, and generate the gate clock signal based on the clock recovery signal RS.

The calculator 610 may receive the on-clock signal ON CLK and the off-clock signal OFF CLK, and calculate the gate clock reference time CT. In an embodiment, the calculator 610 may receive the on-clock signal ON CLK and the off-clock signal OFF CLK from the driving controller 200. The calculator 610 may calculate a time during which the activation period of the gate clock signal is maintained based on the on-clock signal ON CLK and the off-clock signal OFF CLK. The calculator 610 may calculate the gate clock reference time CT by calculating the time during which the activation period of the gate clock signal is maintained. In an embodiment, the gate clock reference time CT may be calculated as a multiplication of a time during which an activation period of the on-clock signal ON CLK is maintained and the number of types of gate clock signals. The number of types of gate clock signals may be represented by phases and clocks of the gate clock signal. In one embodiment, for example, when a time during which the activation period of the on-clock signal ON CLK is maintained is one horizontal period (1H), and the number of types of gate clock signals is 2, the gate clock reference time CT may be 1H×2 phases. The gate clock reference time CT may represent a time during which the activation period of the gate clock signal is set to be maintained when the gate clock signal is the normal signal. The calculator 610 may transmit the gate clock reference time CT to the comparator 620.

The comparator 620 may receive the gate clock reference time CT and the gate clock actual time RT, and generate the clock recovery signal RS. In an embodiment, the comparator 620 may receive the gate clock reference time CT from the calculator 610. The comparator 620 may obtain the gate clock actual time RT by feeding back the gate clock signal output from an output terminal OP of the power supply voltage generator 600. The comparator 620 may determine whether the gate clock reference time CT and the gate clock actual time RT are different from each other by comparing the gate clock reference time CT with the gate clock actual time RT. When the gate clock reference time CT and the gate clock actual time RT are the same as each other, the gate clock signal may be the normal signal. When the gate clock reference time CT and the gate clock actual time RT are different from each other, the gate clock signal may be the abnormal signal. If the abnormal gate clock signal is input to the gate driver, the display panel may display an abnormal image. The comparator 620 may generate the clock recovery signal RS when the gate clock reference time CT and the gate clock actual time RT are different from each other. The comparator 620 may transmit the clock recovery signal RS to the gate controller 630. The clock recovery signal RS may allow the gate controller 630 to change a count value of an abnormal on-clock signal ON CLK or a count value of an abnormal off-clock signal OFF CLK.

The gate controller 630 may receive the on-clock signal ON CLK and the off-clock signal OFF CLK, and generate the gate clock signal based on the clock recovery signal RS. In an embodiment, the gate controller 630 may receive the on-clock signal ON CLK and the off-clock signal OFF CLK from the driving controller 200. The gate controller 630 may generate the gate clock signal based on the on-clock signal ON CLK and the off-clock signal OFF CLK. The gate controller 630 may output the gate clock signal to the output terminal OP of the power supply voltage generator 600. The gate controller 630 may feedback and input the gate clock signal to the comparator 620. When the gate clock signal is the abnormal signal, the gate controller 630 may receive the clock recovery signal RS from the comparator 620. The gate controller 630 may correct the gate clock signal into a normal signal by increasing or decreasing the count value of the on-clock signal ON CLK or the off-clock signal OFF CLK based on the clock recovery signal RS. In one embodiment, for example, the gate controller 630 may receive the clock recovery signal RS, and adjust the length of the activation period of the gate clock signal by increasing or decreasing the count value of the on-clock signal ON CLK or the off-clock signal OFF CLK. In such an embodiment, the length of the activation period of the gate clock signal is adjusted in a way such that the gate clock signal may be corrected into the normal signal. In such an embodiment, the gate clock signal is corrected into the normal signal, such that the display panel may display a normal image. Accordingly, in an embodiment of the display device, the visual recognition of the noise by the user may be minimized, and the display quality defects of the display device may be reduced.

Figure 5:
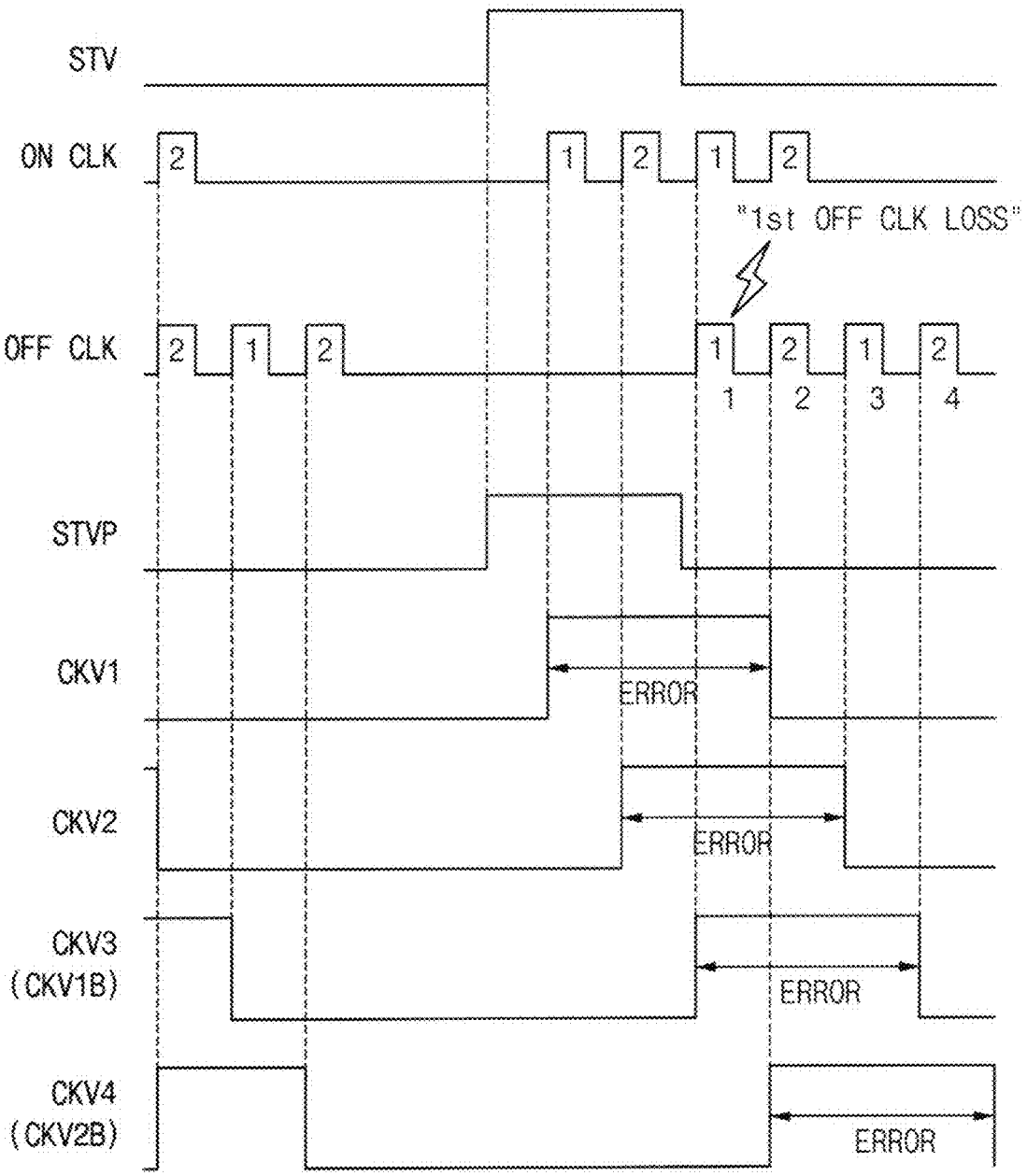
FIG. 5 is a timing diagram showing a case in which a gate clock signal is an abnormal signal.
Figure 6:
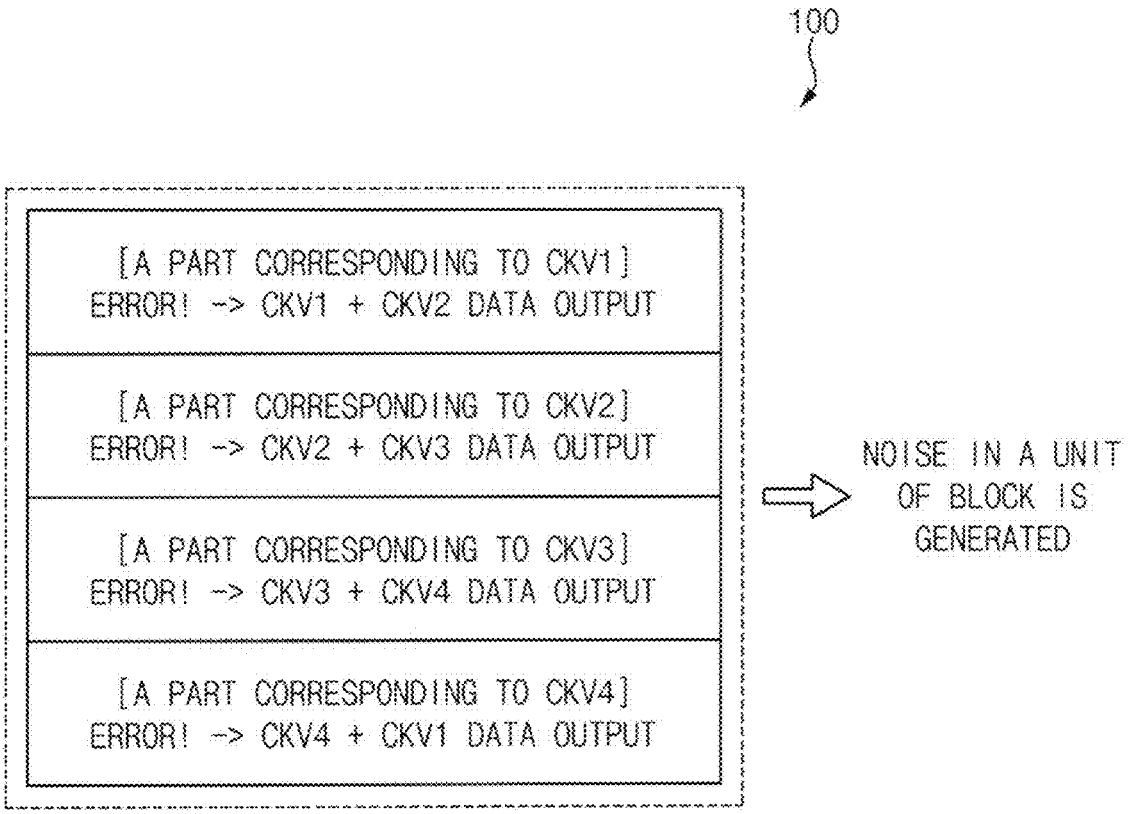
FIG. 6 is a diagram showing a display panel in which noise is generated by the abnormal signal of FIG. 5.
Figure 7:
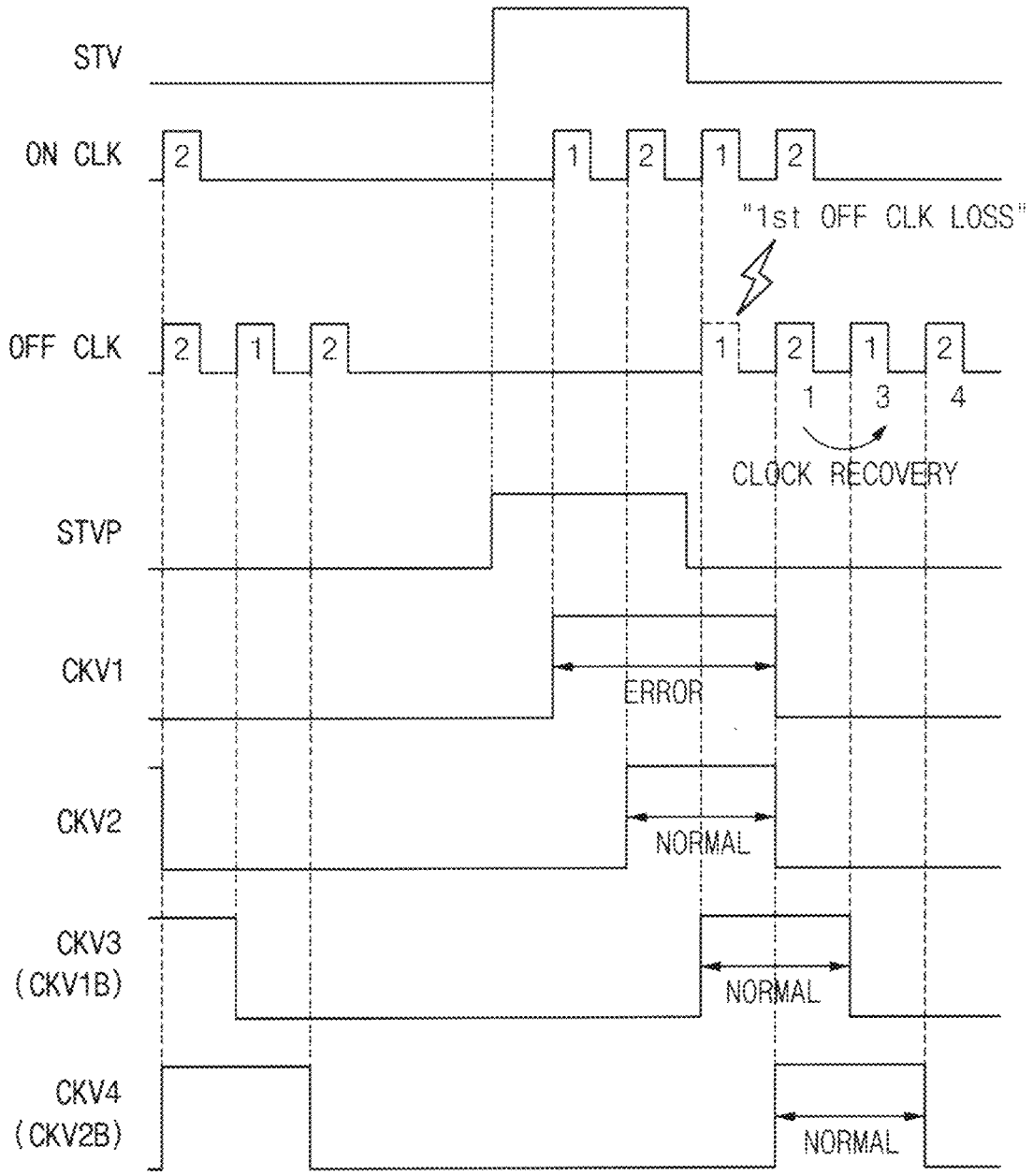
FIG. 7 is a timing diagram showing a gate clock signal corrected into a normal signal when a gate clock signal is an abnormal signal in an embodiment.
Figure 8:
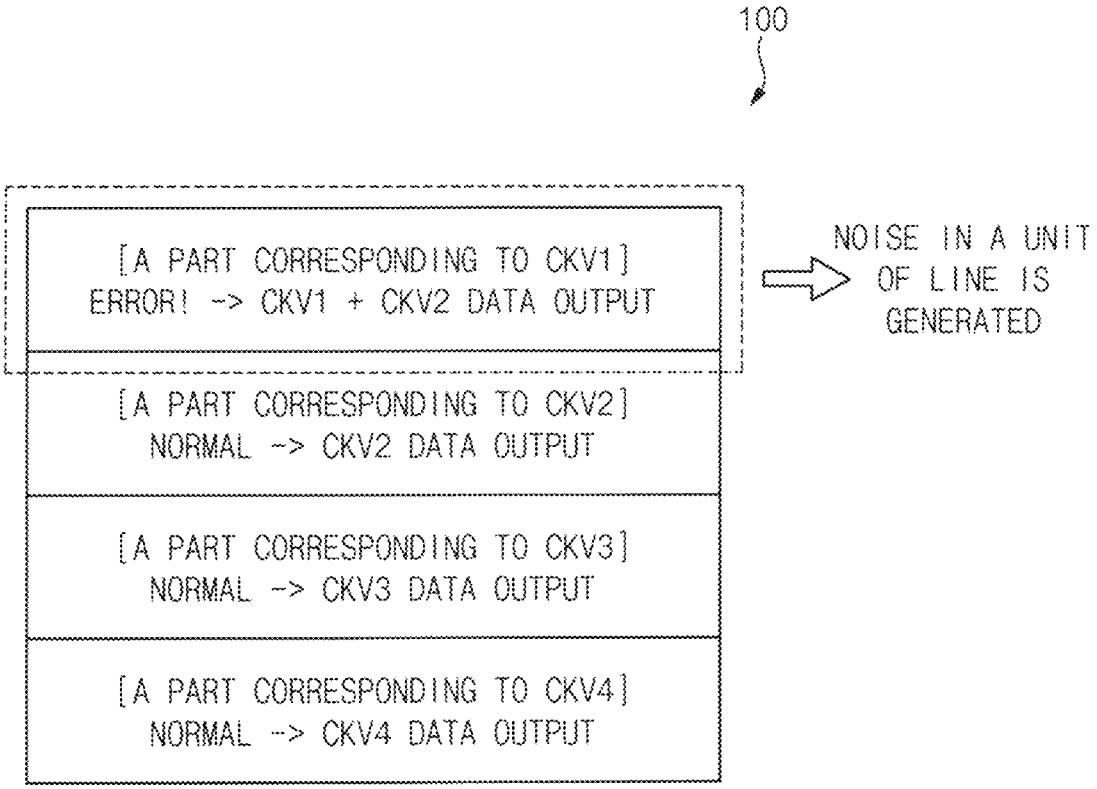
FIG. 8 is a diagram showing a display panel in which a noise is corrected by the gate clock signal correction of FIG. 7.

FIG. 5 is a timing diagram showing a case in which a gate clock signal is an abnormal signal, FIG. 6 is a diagram showing a display panel in which noise is generated by the abnormal signal of FIG. 5, FIG. 7 is a timing diagram showing a gate clock signal corrected into a normal signal when a gate clock signal is an abnormal signal in embodiments, and FIG. 8 is a diagram showing a display panel in which a noise is corrected by the gate clock signal correction of FIG. 7.

Referring to FIGS. 3 to 6, in an embodiment, the power supply voltage generator 600 may receive the on-clock signal ON CLK, the off-clock signal OFF CLK, and the vertical start signal STV from the driving controller 200. The power supply voltage generator 600 may generate the gate clock signal CKV and the gate start signal STVP based on the on-clock signal ON CLK, the off-clock signal OFF CLK, and the vertical start signal STV. The gate clock signal may be controlled based on the on-clock signal ON CLK and the off-clock signal OFF CLK. In one embodiment, for example, a rising time of each of gate clock signals at which the gate clock signal rises from a gate low voltage to a gate high voltage may be determined by a rising edge of the on-clock signal ON CLK. In one embodiment, for example, a falling time of each of the gate clock signals at which the gate clock signal falls from the gate high voltage to the gate low voltage may be determined by a falling edge of the off-clock signal OFF CLK. Each of a plurality of gate clock signals may have an activation period (e.g., a gate high voltage period) that partially overlaps an activation period of an adjacent gate clock signal. The power supply voltage generator 600 may generate the gate clock signal CKV and the gate start signal STVP to output the generated gate clock signal CKV and the generated gate start signal STVP to the gate driver 300. Although FIG. 5 shows an embodiment where the gate clock signals have two phases and four clocks, embodiments of the disclosure are not limited thereto.

In an embodiment, the power supply voltage generator 600 may count the activation period of the on-clock signal ON CLK or the off-clock signal OFF CLK. In one embodiment, for example, the power supply voltage generator 600 may further include a counter configured to count the activation period of the on-clock signal ON CLK or the off-clock signal OFF CLK. The counter may be disposed inside the power supply voltage generator 600, or may be disposed outside the power supply voltage generator 600 to communicate with the power supply voltage generator 600. In an embodiment, as shown in FIG. 3, when the gate clock signal includes two phases and four clocks, the counter may perform an operation of dividing the activation period of the on-clock signal ON CLK or the off-clock signal OFF CLK into 1, 2, 3, and 4, and repeatedly counting the divided activation period. The gate clock signal may be controlled in synchronization with the count values of the on-clock signal ON CLK and the off-clock signal OFF CLK. In one embodiment, for example, the gate clock signal may be synchronized with a corresponding count value of the on-clock signal ON CLK to rise from the gate low voltage to the gate high voltage. In one embodiment, for example, the gate clock signal may be synchronized with a corresponding count value of the off-clock signal OFF CLK to fall from the gate high voltage to the gate low voltage.

In an embodiment, the on-clock signal ON CLK and the off-clock signal OFF CLK may be lost by the malfunction of the driving controller 200 caused by the external factor such as static electricity or a momentary electrical surge. In this case, the gate clock signal generated by the power supply voltage generator 600 may be the abnormal signal (e.g., "ERROR" in CKV1, CKV2, CKV3 and CVK4). When the abnormal gate clock signal is input to the gate driver, the display panel may display an abnormal image. A part of the off-clock signal OFF CLK input to the power supply voltage generator 600 may be lost. In this case, the gate clock signal may rise to the gate high voltage by the rising edge of the on-clock signal ON CLK, whereas the gate clock signal may not normally fall to the gate low voltage due to the lost off-clock signal OFF CLK ("1st OFF CLK LOSS"). Therefore, the activation period of the gate clock signal may be lengthened. As shown in FIG. 5, when a first off-clock signal OFF CLK is lost, a first gate clock signal CKV1 may rise to the gate high voltage by a first on-clock signal ON CLK, whereas the first gate clock signal CKV1 may fall to the gate low voltage by a second off-clock signal OFF CLK instead of the first off-clock signal. Similarly, a second gate clock signal CKV2 may rise to the gate high voltage by a second on-clock signal ON CLK, whereas the second gate clock signal CKV2 may fall to the gate low voltage by a third off-clock signal OFF CLK instead of the second off-clock signal OFF CLK. If such a phenomenon occurs, an overlapping period may be generated among the gate clock signals due to the abnormal gate clock signals. As shown in FIG. 6, an image displayed on the display panel may have noise in a unit of block over the whole display panel because data corresponding to each of the gate clock signals is duplicated and output due to the overlapping of gate clock signals. Such noise in the unit of block may cause the display quality defects, and may be visually recognized by the user.

In an embodiment of the display device according to the invention, the power supply voltage generator 600 may determine whether the gate clock signal is an abnormal signal, and change the count value of the on-clock signal ON CLK or the off-clock signal OFF CLK when the gate clock signal is the abnormal signal. The power supply voltage generator 600 may determine whether the gate clock signal is the abnormal signal based on the length of the activation period of the gate clock signal. When the gate clock signal is determined as the abnormal signal, the count value of the on-clock signal ON CLK or the off-clock signal OFF CLK is changed, such that the gate clock signal may be corrected into a normal signal.

In an embodiment, as shown in FIGS. 7 and 8, when the on-clock signal ON CLK or the off-clock signal OFF CLK is lost, the comparator 620 may detect the abnormal signal of the gate clock signal, and generate the clock recovery signal RS. The comparator 620 may transmit the clock recovery signal RS to the gate controller 630. The gate controller 630 may receive the clock recovery signal RS, and recover a counter value of the lost on-clock signal ON CLK or the lost off-clock signal OFF CLK. In such an embodiment, the gate controller 630 may recover a count value before a loss of the on-clock signal ON CLK by decreasing the count value of the on-clock signal ON CLK when the gate clock signal is the abnormal signal due to the loss of the on-clock signal ON CLK. In such an embodiment, the gate controller 630 may recover a count value before a loss of the off-clock signal OFF CLK by increasing the count value of the off-clock signal OFF CLK when the gate clock signal is the abnormal signal due to the loss of the off-clock signal OFF CLK. In one embodiment, for example, when a first off-clock signal OFF CLK is lost, the gate controller 630 may increase a count value of a second off-clock signal OFF CLK from 1 to 2 based on the clock recovery signal RS. In such an embodiment, the gate controller 630 may increase a count value of a third off-clock signal OFF CLK from 2 to 3. In this case, a first gate clock signal may be abnormally output, whereas a second gate clock signal, a third gate clock signal, and a fourth gate clock signal may be synchronized with a normal off-clock signal OFF CLK to be output as normal signals. In an embodiment, as shown in FIG. 8, the image displayed on the display panel may be a normal image except for data corresponding to the first gate clock signal, which is an abnormal signal. In such an embodiment, noise in a unit of line may be generated in the display panel. Such noise in the unit of line may not be generally recognized by the user, so that the display quality defects may be minimized.

Figure 9:
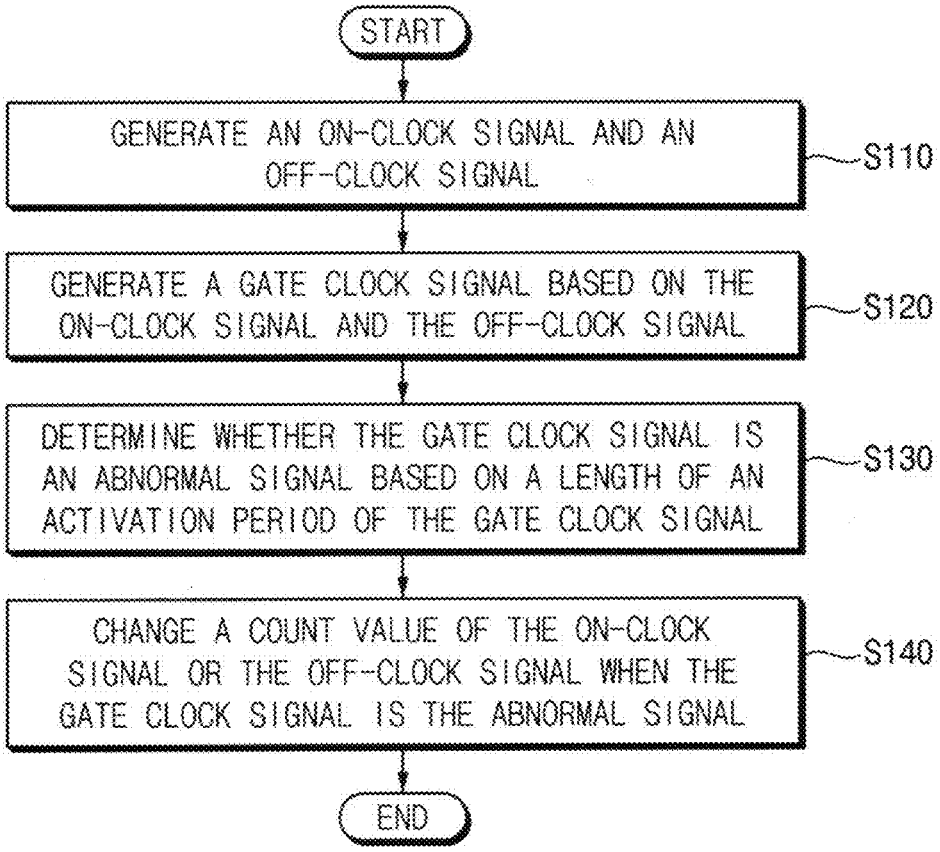
FIG. 9 is a flowchart showing an operation of a display device according to an embodiment.

FIG. 9 is a flowchart showing an operation of a display device according to an embodiment.

Referring to FIGS. 1 and 4 to 9, an embodiment of a display device may generate an on-clock signal ON CLK and an off-clock signal OFF CLK (S110), generate a gate clock signal based on the on-clock signal ON CLK and the off-clock signal OFF CLK (S120), determine whether the gate clock signal is an abnormal signal based on a length of an activation period of the gate clock signal (S130), and change a count value of the on-clock signal ON CLK or the off-clock signal OFF CLK when the gate clock signal is the abnormal signal (S140).

In an embodiment, the display device may generate the on-clock signal ON CLK and the off-clock signal OFF CLK (S110), and generate the gate clock signal based on the on-clock signal ON CLK and the off-clock signal OFF CLK (S120). In such an embodiment, a power supply voltage generator 600 may receive the on-clock signal ON CLK, the off-clock signal OFF CLK, and a vertical start signal STV from a driving controller 200. The power supply voltage generator 600 may generate the gate clock signal CKV and a gate start signal STVP based on the on-clock signal ON CLK, the off-clock signal OFF CLK, and the vertical start signal STV. The gate clock signal may be controlled based on the on-clock signal ON CLK and the off-clock signal OFF CLK. In one embodiment, for example, a rising time of each of gate clock signals at which the gate clock signal rises from a gate low voltage to a gate high voltage may be determined by a rising edge of the on-clock signal ON CLK. In one embodiment, for example, a falling time of each of the gate clock signals at which the gate clock signal falls from the gate high voltage to the gate low voltage may be determined by a falling edge of the off-clock signal OFF CLK.

In an embodiment, the display device may determine whether the gate clock signal is an abnormal signal based on a length of an activation period of the gate clock signal (S130). In an embodiment, the calculator 610 may calculate a time during which an activation period of the gate clock signal is maintained based on the on-clock signal ON CLK and the off-clock signal OFF CLK. The calculator 610 may calculate a gate clock reference time CT by calculating the time during which the activation period of the gate clock signal is maintained. In such an embodiment, the gate clock reference time CT may be calculated as a multiplication of a time during which an activation period of the on-clock signal ON CLK is maintained and a number of types of gate clock signals. The calculator 610 may transmit the gate clock reference time CT to the comparator 620. The comparator 620 may obtain a gate clock actual time RT by feeding back the gate clock signal output from an output terminal OP of the power supply voltage generator 600. The comparator 620 may determine whether the gate clock reference time CT and the gate clock actual time RT are different from each other by comparing the gate clock reference time CT with the gate clock actual time RT. When the gate clock reference time CT and the gate clock actual time RT are the same, the gate clock signal may be a normal signal. When the gate clock reference time CT and the gate clock actual time RT are different from each other, the gate clock signal may be the abnormal signal. The comparator 620 may generate a clock recovery signal RS when the gate clock reference time CT and the gate clock actual time RT are different from each other, and transmit the clock recovery signal RS to the gate controller 630.

In an embodiment, the display device may change a count value of the on-clock signal ON CLK or the off-clock signal OFF CLK when the gate clock signal is the abnormal signal (S140). In detail, the gate controller 630 may receive the clock recovery signal RS, and recover a counter value of a lost on-clock signal ON CLK or a lost off-clock signal OFF CLK. The gate controller 630 may recover a count value before a loss of the on-clock signal ON CLK by decreasing the count value of the on-clock signal ON CLK when the gate clock signal is the abnormal signal due to the loss of the on-clock signal ON CLK In an embodiment, the gate controller 630 may recover a count value before a loss of the off-clock signal OFF CLK by increasing the count value of the off-clock signal OFF CLK when the gate clock signal is the abnormal signal due to the loss of the off-clock signal OFF CLK. In such an embodiment, a gate clock signal in which the on-clock signal ON CLK or the off-clock signal OFF CLK is lost may be abnormally output, whereas the remaining gate clock signals may be synchronized with a normal on-clock signal ON CLK or a normal off-clock signal OFF CLK so as to be output as normal signals.

Figure 10:
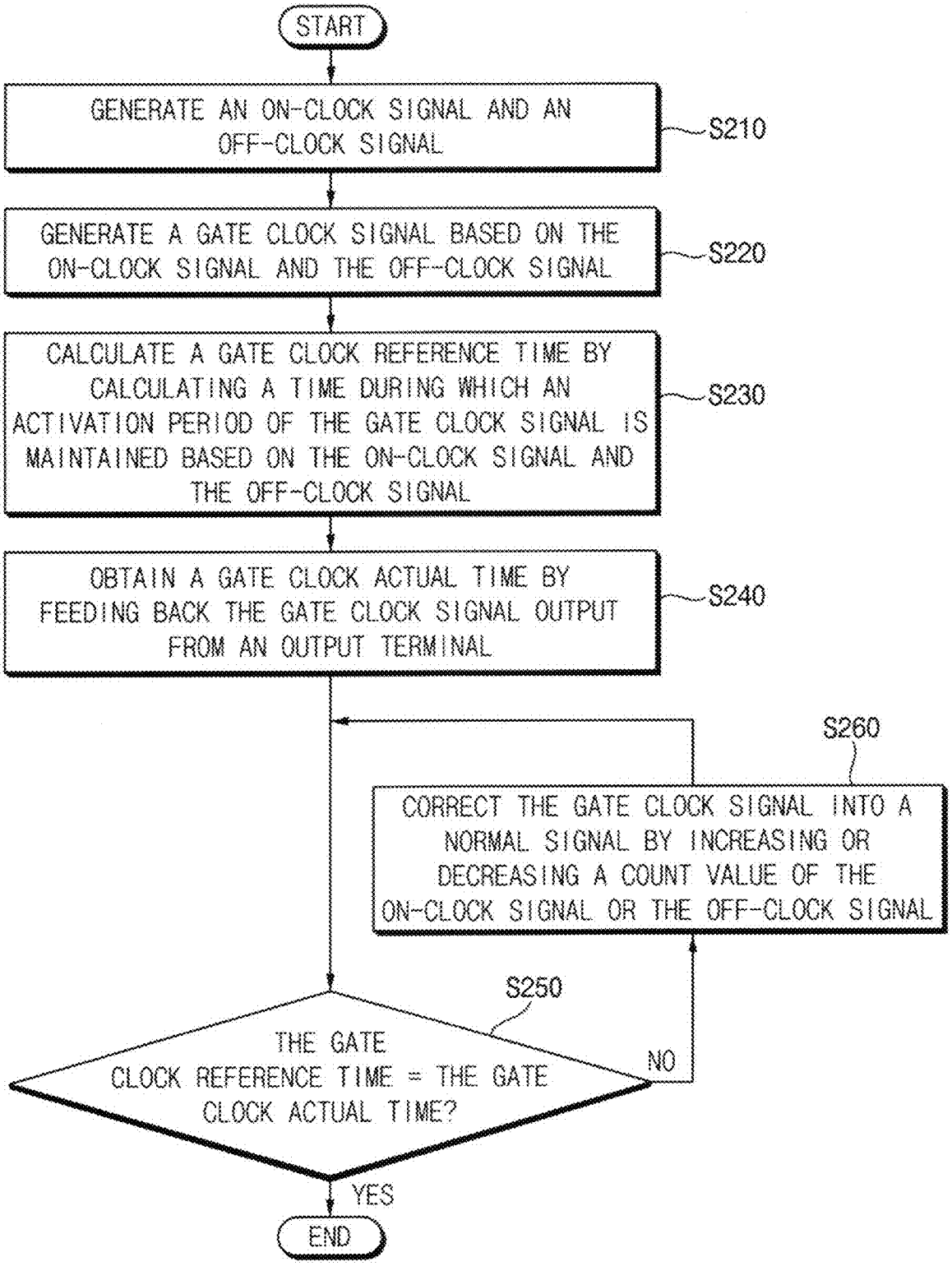
FIG. 10 is a flowchart showing an operation of a display device according to an alternative embodiment.

FIG. 10 is a flowchart showing an operation of a display device according to an alternative embodiment.

Referring to FIGS. 1 to 10, an alternative embodiment of a display device may generate an on-clock signal ON CLK and an off-clock signal OFF CLK (S210), generate a gate clock signal based on the on-clock signal ON CLK and the off-clock signal OFF CLK (S220), calculate a gate clock reference time CT by calculating a time during which an activation period of the gate clock signal is maintained based on the on-clock signal ON CLK and the off-clock signal OFF CLK (S230), obtain a gate clock actual time RT by feeding back the gate clock signal output from an output terminal OP (S240), compare the gate clock reference time CT with the gate clock actual time RT (S250), and correct the gate clock signal into a normal signal by increasing or decreasing a count value of the on-clock signal ON CLK or the off-clock signal OFF CLK when the gate clock reference time CT and the gate clock actual time RT are different from each other (S260).

In an embodiment, the display device may generate the on-clock signal ON CLK and the off-clock signal OFF CLK (S210), and generate the gate clock signal based on the on-clock signal ON CLK and the off-clock signal OFF CLK (S220). In such an embodiment, a power supply voltage generator 600 may receive the on-clock signal ON CLK, the off-clock signal OFF CLK, and a vertical start signal STV from a driving controller 200. The power supply voltage generator 600 may generate the gate clock signal CKV and a gate start signal STVP based on the on-clock signal ON CLK, the off-clock signal OFF CLK, and the vertical start signal STV. The gate clock signal may be controlled based on the on-clock signal ON CLK and the off-clock signal OFF CLK. In one embodiment, for example, a rising time of each of gate clock signals at which the gate clock signal rises from a gate low voltage to a gate high voltage may be determined by a rising edge of the on-clock signal ON CLK. In one embodiment, for example, a falling time of each of the gate clock signals at which the gate clock signal falls from the gate high voltage to the gate low voltage may be determined by a falling edge of the off-clock signal OFF CLK.

In an embodiment, the display device may calculate the gate clock reference time CT by calculating the time during which the activation period of the gate clock signal is maintained based on the on-clock signal ON CLK and the off-clock signal OFF CLK (S230). In an embodiment, a calculator 610 may receive the on-clock signal ON CLK and the off-clock signal OFF CLK from the driving controller 200. The calculator 610 may calculate the time during which the activation period of the gate clock signal is maintained based on the on-clock signal ON CLK and the off-clock signal OFF CLK. The calculator 610 may calculate the gate clock reference time CT by calculating the time during which the activation period of the gate clock signal is maintained. In such an embodiment, the gate clock reference time CT may be calculated as a multiplication of a time during which an activation period of the on-clock signal ON CLK is maintained and a number of types of gate clock signals. The number of types of gate clock signals may be represented by phases and clocks of the gate clock signal. In one embodiment, for example, where a time during which the activation period of the on-clock signal ON CLK is maintained is 1H, and the number of types of gate clock signals is 2, the gate clock reference time CT may be 1H×2 phases. The gate clock reference time CT may represent a time during which the activation period of the gate clock signal is set to be maintained when the gate clock signal is the normal signal. The calculator 610 may transmit the gate clock reference time CT to a comparator 620.

In an embodiment, the display device may obtain the gate clock actual time RT by feeding back the gate clock signal output from the output terminal OP (S240), and compare the gate clock reference time CT with the gate clock actual time RT (S250). In such an embodiment, the comparator 620 may receive the gate clock reference time CT from the calculator 610. The comparator 620 may obtain the gate clock actual time RT by feeding back the gate clock signal output from the output terminal OP of the power supply voltage generator 600. The comparator 620 may determine whether the gate clock reference time CT and the gate clock actual time RT are different from each other by comparing the gate clock reference time CT with the gate clock actual time RT. When the gate clock reference time CT and the gate clock actual time RT are the same as each other, the gate clock signal may be the normal signal. When the gate clock reference time CT and the gate clock actual time RT are different from each other, the gate clock signal may be the abnormal signal. If the abnormal gate clock signal is input to the gate driver, a display panel may display an abnormal image. In an embodiment, the comparator 620 may generate the clock recovery signal RS when the gate clock reference time CT and the gate clock actual time RT are different from each other. The comparator 620 may transmit the clock recovery signal RS to a gate controller 630. The clock recovery signal RS may allow the gate controller 630 to change a count value of an abnormal on-clock signal ON CLK or a count value of an abnormal off-clock signal OFF CLK.

In an embodiment, the power supply voltage generator 600 may count the activation period of the on-clock signal ON CLK or the off-clock signal OFF CLK. In one embodiment, for example, the power supply voltage generator 600 may further include a counter configured to count the activation period of the on-clock signal ON CLK or the off-clock signal OFF CLK. The counter may be disposed inside the power supply voltage generator 600, or may be disposed outside the power supply voltage generator 600 to communicate with the power supply voltage generator 600. As shown in FIG. 3, when the gate clock signal includes two phases and four clocks, the counter may perform an operation of dividing the activation period of the on-clock signal ON CLK or the off-clock signal OFF CLK into 1, 2, 3, and 4, and repeatedly counting the divided activation period. The gate clock signal may be controlled in synchronization with the count values of the on-clock signal ON CLK and the off-clock signal OFF CLK. In one embodiment, for example, the gate clock signal may be synchronized with a corresponding count value of the on-clock signal ON CLK to rise from the gate low voltage to the gate high voltage. In one embodiment, for example, the gate clock signal may be synchronized with a corresponding count value of the off-clock signal OFF CLK to fall from the gate high voltage to the gate low voltage.

In an embodiment, the display device may correct the gate clock signal into the normal signal by increasing or decreasing the count value of the on-clock signal ON CLK or the off-clock signal OFF CLK when the gate clock reference time CT and the gate clock actual time RT are different from each other (S260). In detail, the gate controller 630 may receive the on-clock signal ON CLK and the off-clock signal OFF CLK from the driving controller 200. The gate controller 630 may generate the gate clock signal based on the on-clock signal ON CLK and the off-clock signal OFF CLK. The gate controller 630 may output the gate clock signal to the output terminal OP of the power supply voltage generator 600. The gate controller 630 may feedback and input the gate clock signal to the comparator 620. When the gate clock signal is the abnormal signal, the gate controller 630 may receive the clock recovery signal RS from the comparator 620. The gate controller 630 may correct the gate clock signal into a normal signal by increasing or decreasing the count value of the on-clock signal ON CLK or the off-clock signal OFF CLK according to the clock recovery signal RS. In one embodiment, for example, the gate controller 630 may recover a count value before a loss of the on-clock signal ON CLK by decreasing the count value of the on-clock signal ON CLK when the gate clock signal is the abnormal signal due to the loss of the on-clock signal ON CLK. In addition, the gate controller 630 may recover a count value before a loss of the off-clock signal OFF CLK by increasing the count value of the off-clock signal OFF CLK when the gate clock signal is the abnormal signal due to the loss of the off-clock signal OFF CLK. As shown in FIG. 7, when a first off-clock signal OFF CLK is lost, the gate controller 630 may increase a count value of a second off-clock signal OFF CLK from 1 to 2 based on the clock recovery signal RS. Similarly, the gate controller 630 may increase a count value of a third off-clock signal OFF CLK from 2 to 3. In this case, a first gate clock signal may be abnormally output, whereas a second gate clock signal, a third gate clock signal, and a fourth gate clock signal may be synchronized with a normal off-clock signal OFF CLK so as to be output as normal signals. Accordingly, as shown in FIG. 8, an image displayed on the display panel may be a normal image except for data corresponding to the first gate clock signal, which is an abnormal signal. In other words, noise in a unit of line may be generated in the display panel. Such noise in the unit of line may not be generally recognized by a user, so that display quality defects may be minimized. Accordingly, according to the display device, visual recognition of the noise by the user may be minimized, and the display quality defects of the display device may be reduced.

Figure 11:
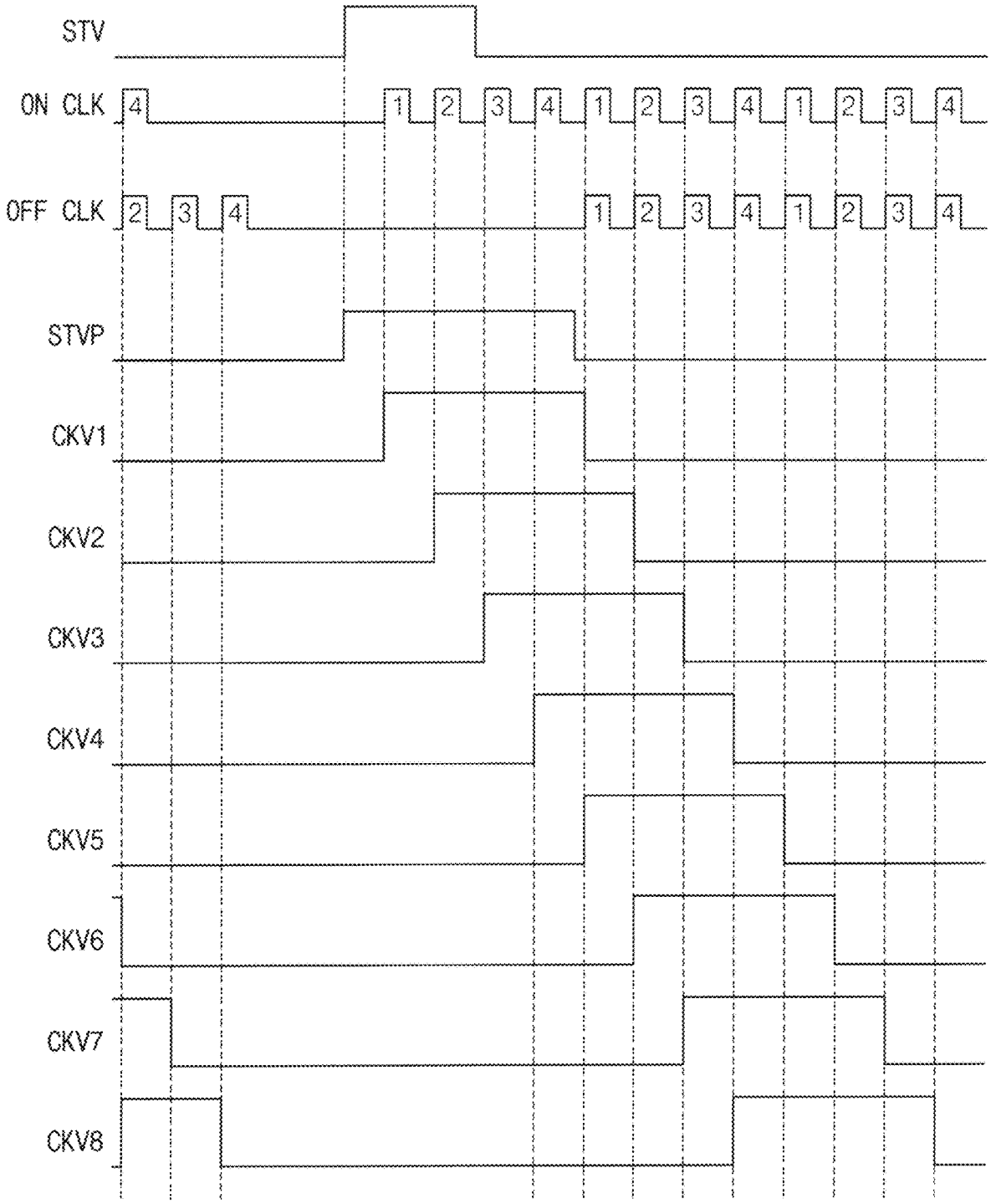
FIG. 11 is a timing diagram showing an alternative embodiment of input and output signals of the power supply voltage generator 600 in FIG. 1.

FIG. 11 is a timing diagram showing another example of input and output signals of the power supply voltage generator 600 in FIG. 1.

Referring to FIGS. 1 and 11, FIG. 11 may show one embodiment of input and output signals of the power supply voltage generator 600 when the gate clock signal includes four phases (e.g., 1 to 4 in the on-clock signal ON CLK and the off-clock signal OFF CLK) and eight clocks (e.g., first to eighth clock signals CKV1 to CKV8). The power supply voltage generator 600 may receive the on-clock signal ON CLK, the off-clock signal OFF CLK, and the vertical start signal STV from the driving controller 200. The power supply voltage generator 600 may generate the gate clock signal CKV and the gate start signal STVP based on the on-clock signal ON CLK, the off-clock signal OFF CLK, and the vertical start signal STV. In such an embodiment, a rising time of each of gate clock signals at which the gate clock signal rises from a gate low voltage to a gate high voltage may be determined by a rising edge of the on-clock signal ON CLK. In such an embodiment, a falling time of each of the gate clock signals at which the gate clock signal falls from the gate high voltage to the gate low voltage may be determined by a falling edge of the off-clock signal OFF CLK. Each of a plurality of gate clock signals may have an activation period (e.g., a gate high voltage period) that partially overlaps an activation period of an adjacent gate clock signal. The power supply voltage generator 600 may generate the gate clock signal CKV and the gate start signal STVP to output the generated gate clock signal CKV and the generated gate start signal STVP to the gate driver 300. Although FIG. 11 shows an embodiment where the gate clock signals have four phases and eight clocks, embodiments of the disclosure are not limited thereto, and the types of the gate clock signal of the disclosure may include various phases and clocks, such as 6 phases and 12 clocks, or 8 phases and 16 clocks.

The on-clock signal ON CLK and the off-clock signal OFF CLK may be abnormally output due to the malfunction of the driving controller 200 caused by the external factor such as static electricity or a momentary electrical surge. In this case, the gate clock signal generated by the power supply voltage generator 600 may also be an abnormal signal. If such an abnormal gate clock signal is input to the gate driver, the display panel may display an abnormal image. In embodiments of the disclosure, the display device may include: a display panel including a gate line, a data line, and a pixel electrically connected to the gate line and the data line, where the display panel displays an image based on input image data; a gate driver which outputs a gate signal to the gate line; a data driver which outputs a data voltage to the data line; and a power supply voltage generator 600 which provides a driving voltage to the display panel, the gate driver, and the data driver. In such embodiments, the power supply voltage generator 600 may generate the gate clock signal based on the on-clock signal ON CLK and the off-clock signal OFF CLK, and change the count value of the on-clock signal ON CLK or the off-clock signal OFF CLK when the gate clock signal is the abnormal signal. Accordingly, in embodiments of the display device of the disclosure, the visual recognition of the noise by the user may be minimized, and the display quality defects of the display device may be reduced.

According to embodiments of the display device and the method of driving the display device of the disclosure as described above, safety and reliability of the display device may be improved.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel including a gate line, a data line, and a pixel electrically connected to the gate line and the data line, wherein the display panel displays an image based on input image data;

a gate driver which outputs a gate signal to the gate line;

a data driver which outputs a data voltage to the data line; and a power supply voltage generator which provides a driving voltage to the display panel, the gate driver and the data driver, wherein the power supply voltage generator generates a gate clock signal based on an on-clock signal and an off-clock signal, and the power supply voltage generator changes a count value of the on-clock signal or the off-clock signal in a way such that the gate clock signal is corrected into a normal signal, which allows the display panel to display the image, when the gate clock signal is an abnormal signal.

2. The display device of claim 1, wherein the power supply voltage generator determines whether the gate clock signal is the abnormal signal based on a length of an activation period of the gate clock signal.

3. The display device of claim 2, wherein the power supply voltage generator calculates a gate clock reference time by calculating a time during which the activation period of the gate clock signal is maintained based on the on-clock signal and the off-clock signal.

4. The display device of claim 3, wherein the power supply voltage generator obtains a gate clock actual time by feeding back the gate clock signal output from an output terminal of the power supply voltage generator and determines the gate clock signal as the abnormal signal when the gate clock reference time and the gate clock actual time are different from each other.

5. The display device of claim 2, wherein the power supply voltage generator counts an activation period of the on-clock signal or the off-clock signal and generates the gate clock signal corresponding to the count value of the on-clock signal or the off-clock signal.

6. The display device of claim 5, wherein the power supply voltage generator adjusts the length of the activation period of the gate clock signal by increasing or decreasing the count value of the on-clock signal or the off-clock signal when the gate clock signal is the abnormal signal.

7. The display device of claim 2, wherein the power supply voltage generator includes:

a calculator which calculates a gate clock reference time by calculating a time during which the activation period of the gate clock signal is maintained based on the on-clock signal and the off-clock signal;

a comparator which obtains a gate clock actual time by feeding back the gate clock signal output from an output terminal and compares the gate clock reference time with the gate clock actual time; and a gate controller which outputs the gate clock signal to the output terminal and corrects the gate clock signal into a normal signal by increasing or decreasing the count value of the on-clock signal or the off-clock signal when the gate clock signal is the abnormal signal.

8. The display device of claim 7, wherein the calculator calculates the gate clock reference time as a multiplication of a time during which an activation period of the on-clock signal is maintained and a number of types of the gate clock signal.

9. The display device of claim 7, wherein the comparator generates a clock recovery signal when the gate clock reference time and the gate clock actual time are different from each other and transmits the clock recovery signal to the gate controller.

10. The display device of claim 7, wherein the gate controller recovers a count value before a loss of the on-clock signal by decreasing the count value of the on-clock signal when the gate clock signal is the abnormal signal due to the loss of the on-clock signal.

11. The display device of claim 7, wherein the gate controller recovers a count value before a loss of the off-clock signal by increasing the count value of the off-clock signal when the gate clock signal is the abnormal signal due to the loss of the off-clock signal.

12. A method of driving a display device, the method comprising:

generating an on-clock signal and an off-clock signal;

generating a gate clock signal based on the on-clock signal and the off-clock signal;

determining whether the gate clock signal is an abnormal signal based on a length of an activation period of the gate clock signal; and changing a count value of the on-clock signal or the off-clock signal in a way such that the gate clock signal is corrected into a normal signal, which allows a display panel of the display device to display an image, when the gate clock signal is the abnormal signal.

13. The method of claim 12, further comprising:

calculating a gate clock reference time by calculating a time during which the activation period of the gate clock signal is maintained based on the on-clock signal and the off-clock signal.

14. The method of claim 13, wherein a gate clock actual time is obtained by feeding back the gate clock signal output from an output terminal, and the gate clock signal is determined as the abnormal signal when the gate clock reference time and the gate clock actual time are different from each other.

15. The method of claim 12, further comprising:

counting an activation period of the on-clock signal or the off-clock signal; and generating the gate clock signal corresponding to the count value of the on-clock signal or the off-clock signal.

16. The method of claim 15, wherein the length of the activation period of the gate clock signal is adjusted by increasing or decreasing the count value of the on-clock signal or the off-clock signal when the gate clock signal is the abnormal signal.

17. The method of claim 12, further comprising:

calculating a gate clock reference time by calculating a time during which the activation period of the gate clock signal is maintained based on the on-clock signal and the off-clock signal;

obtaining a gate clock actual time by feeding back the gate clock signal output from an output terminal; and comparing the gate clock reference time with the gate clock actual time, wherein the gate clock signal is output to the output terminal, and the gate clock signal is corrected into a normal signal by increasing or decreasing the count value of the on-clock signal or the off-clock signal when the gate clock signal is the abnormal signal.

18. The method of claim 17, wherein the calculating the gate clock reference time includes:

calculating the gate clock reference time as a multiplication of a time during which an activation period of the on-clock signal is maintained and a number of types of the gate clock signal.

19. The method of claim 17, wherein the comparing the gate clock reference time with the gate clock actual time includes:

generating a clock recovery signal when the gate clock reference time and the gate clock actual time are different from each other.

20. The method of claim 17, wherein the on-clock signal is recovered to have a count value before a loss of the on-clock signal by decreasing the count value of the on-clock signal when the gate clock signal is the abnormal signal due to the loss of the on-clock signal, and the off-clock signal is recovered to have a count value before a loss of the off-clock signal by increasing the count value of the off-clock signal when the gate clock signal is the abnormal signal due to the loss of the off-clock signal.

* * * * *